US008056899B2

(12) United States Patent
Byun et al.

(10) Patent No.: US 8,056,899 B2
(45) Date of Patent: Nov. 15, 2011

(54) PRINT-MEDIUM POST-TREATMENT APPARATUS

(75) Inventors: Chang Soo Byun, Hwaseong-si (KR); Ji Hoon Min, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/862,929

(22) Filed: Aug. 25, 2010

(65) Prior Publication Data

US 2011/0058874 A1 Mar. 10, 2011

(30) Foreign Application Priority Data

Sep. 9, 2009 (KR) ..... 10-2009-0084895

(51) Int. Cl.
*B65H 39/10* (2006.01)

(52) U.S. Cl. ..... 271/303

(58) Field of Classification Search ..... 271/303
See application file for complete search history.

(56) References Cited

U.S. PATENT DOCUMENTS

| | | | | |
|---|---|---|---|---|
| 5,028,046 | A * | 7/1991 | Kuwahara | 271/301 |
| 5,267,729 | A * | 12/1993 | Hirota et al. | 271/297 |
| 2002/0135124 | A1* | 9/2002 | Suzuki et al. | 271/303 |
| 2005/0035540 | A1* | 2/2005 | Carter et al. | 271/303 |
| 2006/0056895 | A1 | 3/2006 | Mizuno et al. | |
| 2008/0181701 | A1 | 7/2008 | Fukasawa et al. | |

FOREIGN PATENT DOCUMENTS

| | | | | |
|---|---|---|---|---|
| JP | 58211479 | | 12/1983 | |
| JP | 60110485 | | 6/1985 | |
| JP | 6216977 | A * | 1/1987 | 271/303 |

OTHER PUBLICATIONS

European Search Report issued Feb. 9, 2011 in EP Application No. 10173457.2.

* cited by examiner

*Primary Examiner* — David H Bollinger
(74) *Attorney, Agent, or Firm* — Stanzione & Kim, LLP

(57) ABSTRACT

Disclosed is a print-medium post-treatment apparatus, in which a converting guide to guide a print medium to any one of a first delivery path and a second delivery path is operated upon receiving rotational force from a delivery motor for delivery of the print medium. This enables omission of a drive device to operate the converting guide.

17 Claims, 5 Drawing Sheets

PRINT-MEDIUM POST-TREATMENT APPARATUS

CROSS-REFERENCE TO RELATED APPLICATIONS

This application claims priority under 35 U.S.C. §119(a) from Korean Patent Application No. 2009-0084895, filed on Sep. 9, 2009 in the Korean Intellectual Property Office, the disclosure of which is incorporated herein in its entirety by reference.

BACKGROUND

1. Field of the Invention

Exemplary embodiments of the present general inventive concept relate to a print-medium post-treatment apparatus to perform post-treatment, such as, e.g., a punching or stapling operation, on a print medium transmitted from an image forming apparatus.

2. Description of the Related Art

In general, a print-medium post-treatment apparatus is arranged parallel to an image forming apparatus. In one example, a print-medium post-treatment apparatus contains a punch or stapler to perform a punching or stapling operation on a print medium, on which an image has been completely formed, transmitted from an image forming apparatus.

Such a print-medium post-treatment apparatus includes a body defining an outer appearance of the print-medium post-treatment apparatus. One side of the body is coupled to an image forming apparatus, and the other side of the body is provided with a first stack tray and a second stack tray. The first stack tray is arranged above the second stack tray, and both are used to support print media, which have been subjected to a punching or stapling operation, loaded thereon.

A first delivery path and a second delivery path are defined in the body, to guide the print media to the first stack tray and the second stack tray. Delivery rollers are arranged on the first delivery path and the second delivery path to move the print media along the first and second delivery paths. A converting guide is provided at a junction of the first delivery path and the second delivery path to allow the print media to move along any one of the first and second delivery paths. A delivery motor to drive the delivery rollers and a converting motor to drive the converting guide are installed in the body.

SUMMARY

Exemplary embodiments of the present general inventive concept provide a print-medium post-treatment apparatus having a smaller size.

Additional features and utilities of the present general inventive concept will be set forth in part in the description which follows and, in part, will be obvious from the description, or may be learned by practice of the present general inventive concept.

Exemplary embodiments of the present general inventive concept provide a print-medium post-treatment apparatus that may include a body, a first stack tray and a second stack tray provided at one side of the body, a first delivery path and a second delivery path to guide a print medium to the first stack tray and the second stack tray, at least one delivery roller arranged on at least one of the first delivery path and the second delivery path, a delivery motor to rotate the delivery roller, a converting guide to guide the print medium to any one of the first delivery path and the second delivery path, a converting cam having a cam surface provided at an outer circumference thereof and adapted to operate the converting guide, and a one-way clutch to selectively transmit rotational force of the delivery motor to the converting cam according to a rotating direction of the delivery motor.

Exemplary embodiments of the print-medium post-treatment apparatus may further include a delivery pulley connected to the delivery roller via a shaft, a delivery belt to transmit the rotational force from the delivery motor to the delivery pulley, and a converting pulley to receive the rotational force via the delivery belt, the one-way clutch being provided between the converting cam and the converting pulley.

The delivery roller may move the print medium via one of the first delivery path and the second delivery path when the delivery motor is rotated in a first direction, and the one-way clutch may selectively transmit the rotational force of the delivery motor to the converting cam only when the delivery motor is rotated in a second direction opposite to the first direction.

Exemplary embodiments of the print-medium post-treatment apparatus may further include a converting lever installed to the converting guide and supported on the cam surface so as to be rotated forward or reverse according to rotation of the converting cam.

Exemplary embodiments of the print-medium post-treatment apparatus may further include a sensor to sense a position of the converting guide.

The sensor may sense a position of the converting lever, to sense the position of the converting guide from the position of the converting lever, and the converting lever may include a lever part supported on the cam surface and a sensing part to be sensed by the sensor.

The sensor may include a light emitting part and a light receiving part, so that the sensing part passes between the light receiving part and the light emitting part.

Exemplary embodiments of the present general inventive concept further include a print-medium post-treatment apparatus that may include a body, a plurality of delivery paths defined in the body to guide a print medium, a delivery motor to generate rotational force so as to move the print medium along the plurality of delivery paths, a converting guide arranged at a junction of the plurality of delivery paths to allow the print medium to move along any one of the plurality of delivery paths, a converting cam to be rotated upon receiving the rotational force from the delivery motor so as to operate the converting guide, and a one-way clutch to selectively transmit rotational force to the converting cam according to a rotating direction of the delivery motor.

Embodiments of the present general inventive concept further include a multifunctional device providing finishing options to print media transmitted from an image forming apparatus including a body; a plurality of stack trays; a plurality of delivery paths to guide print media to the plurality of stack trays; a delivery device comprising at least one delivery belt and a delivery motor to rotate the delivery belt; a converting guide to rotatably guide the print media to one of the first delivery path and second delivery path; a converting pulley connected to the delivery belt to provide a rotational force to the converting guide; and a clutch to allow transmission of the rotational force from the converting pulley to the converting guide only when the converting pulley is rotated in a certain direction.

BRIEF DESCRIPTION OF THE DRAWINGS

Exemplary embodiments of the present general inventive concept will become apparent and more readily appreciated from the following description of the exemplary embodiments, taken in conjunction with the accompanying drawings of which.

DETAILED DESCRIPTION OF THE EXEMPLARY EMBODIMENTS

Figure 1:
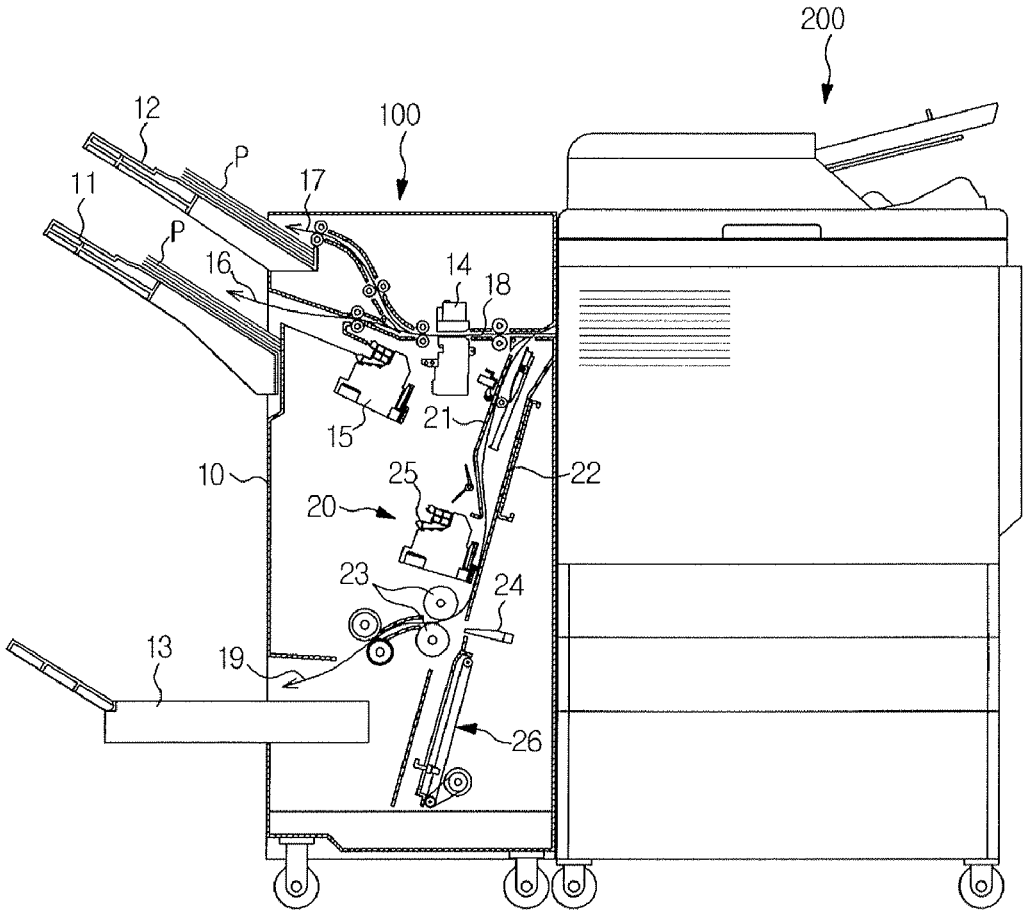
FIG. 1 is a sectional view illustrating a schematic configuration of a print-medium post-treatment apparatus according to an exemplary embodiment of the present general inventive concept.

Reference will now be made in detail to a print-medium post-treatment apparatus according to an exemplary embodiment of the present general inventive concept, examples of which are illustrated in the accompanying drawings, wherein like reference numerals refer to like elements throughout. The exemplary embodiments are described below in order to explain the present general inventive concept by referring to the figures.

Figure 2:
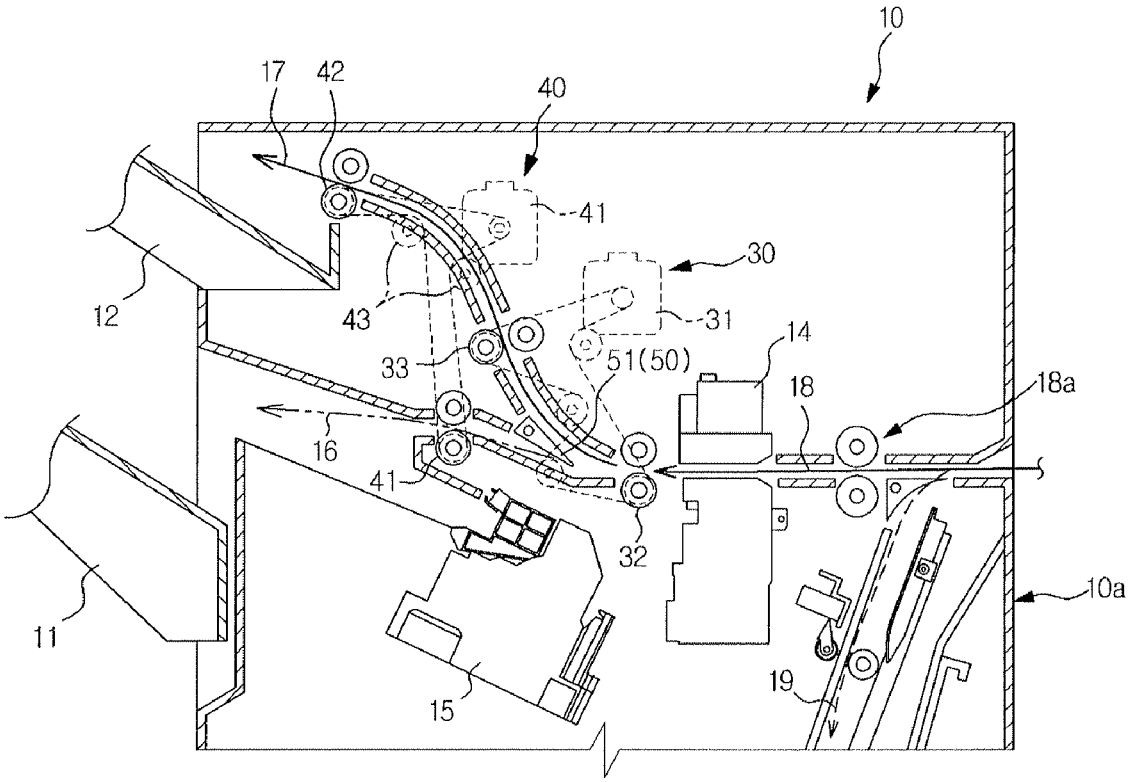
FIG. 2 is a schematic view illustrating print-medium delivery paths defined in the print-medium post-treatment apparatus according to an exemplary embodiment of the present general inventive concept.

As illustrated in FIGS. 1 and 2, the print-medium post-treatment apparatus 100 according to the exemplary embodiment of the present general inventive concept may be coupled to a side of an image forming apparatus 200. The print-medium post-treatment apparatus 100 may be designed to perform, e.g., a bookbinding operation, a punching operation, and a stapling operation on a plurality of print media P, each of which an image has been completely formed, transmitted from the image forming apparatus 200. The bookbinding operation may include an operation to fold the print media P into two on the basis of the center thereof and bind the folded print media P to form a book. The punching operation may include an operation to punch holes required to bind the print media P, and the stapling operation may include an operation to bind the plurality of print media P together.

The print-medium post-treatment apparatus 100 may include a body 10 defining an outer appearance of the apparatus 100, one side of which may connect to the image forming apparatus 200, and a plurality of stack trays 11, 12, and 13 provided at the other side of the body 10 so that print media P, which have been subjected to post-treatment, are to be loaded on the stack trays 11, 12, and 13. In addition, to perform the above mentioned operations, e.g., a bookbinding device 20, a punch 14, and a stapler 15 may be accommodated in the body 10.

The print-medium post-treatment apparatus 100 may include a print media receiving side 10*a* to receive print media from the image forming apparatus 200. The print media receiving side 10*a* may be on a side of the body 10 opposite the side of the body where the stack trays 11, 12, and 13 are positioned.

The plurality of stack trays 11, 12, and 13 may include a first stack tray 11 to load standard sized paper thereon, a second stack tray 12 arranged above the first stack tray 11 to load irregular sized print media P of a predetermined size or more or relatively thick print media P such as envelopes thereon, and a bookbinding stack tray 13 arranged below the first stack tray 11 to load a stack of print media P bound by the bookbinding device 20.

A plurality of delivery paths 16, 17, 18, and 19 may be within the body 10 to guide the print media P to the plurality of stack trays 11, 12, and 13. The delivery paths may include a first delivery path 16 to guide paper to the first stack tray 11, a second delivery path 17 to guide paper to the second stack tray 12, a main delivery path 18, with main delivery path rollers 18*a* thereon, to guide the print media P transmitted from the image forming apparatus 200 to a junction of the first delivery path 16 and the second delivery path 17, and a bookbinding delivery path 19 to guide the print media P to the bookbinding device 20.

The punch 14 may be located on a position of the main delivery path 18 to punch the print media P moving along the main delivery path 18. The stapler 15 may be located on a position of the first delivery path 16 to staple the print media P moving along the first delivery path 16.

The bookbinding device 20 may be arranged in a lower region of the body 10. The bookbinding device 20 may include a guide plate 21 to guide the print media P to drop down, a stack plate 22 having an upper surface on which the print media P is loaded, a pair of press rollers 23 arranged to face the upper surface of the stack plate 22, a bookbinding stapler 25 to bind the print media P to form a book, a folding knife 24 to protrude from the stack plate 22 and enter a gap between the pair of press rollers 23 so as to fold the print media P loaded on the stack plate 22, and a lifting device 26 to move the print media P loaded on the stack plate 22 up or down according to a size of the print media P.

In addition, the body 10 may accommodate a delivery device 30 to move the print media P along the first delivery path 16 and the second delivery path 17, a discharge device 40 to discharge the print media P to the first stack tray 11 and the second stack tray 12, and a path converting device 50 to allow the print media P to be selectively delivered to any one of the first delivery path 16 and the second delivery path 17.

The delivery device 30 may include a delivery motor 31 that is rotatable forward or in reverse, and a plurality of delivery rollers 32 and 33 arranged on the first delivery path 16 and the second delivery path 17. The discharge device 40 may include a discharge motor 41 to generate rotational force, and a plurality of discharge rollers 42 and 43 to discharge the print media P to the first stack tray 11 and the second stack tray 12.

Figure 3:
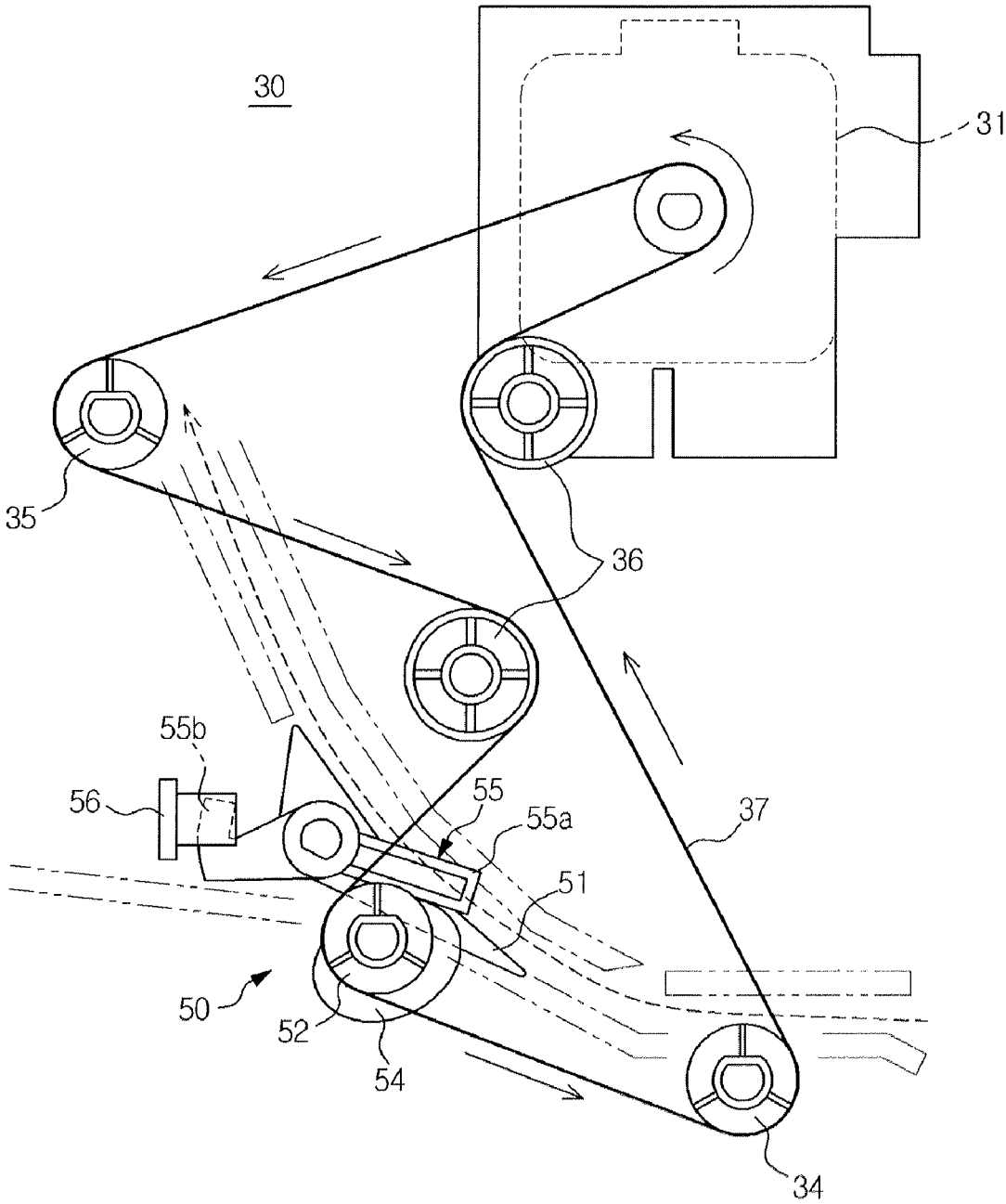
FIG. 3 is a schematic view illustrating a delivery device provided in the print-medium post-treatment apparatus according to an exemplary embodiment of the present general inventive concept.

The delivery device 30, as illustrated in FIG. 3, may further include a plurality of delivery pulleys 34 and 35, a delivery belt 37, and a plurality of idle rollers 36. The delivery pulleys 34 and 35 may connect to the respective delivery rollers 32 and 33 using shafts to transmit rotational force of the delivery motor 31 to the delivery rollers 32 and 33. The delivery belt 37 may connect the delivery motor 31 and the delivery pulleys 34 and 35 to each other to transmit rotational force generated from the delivery motor 31 to the delivery pulleys 34 and 35. The plurality of idle rollers 36 may serve to maintain tension of the delivery belt 37.

Figure 4:
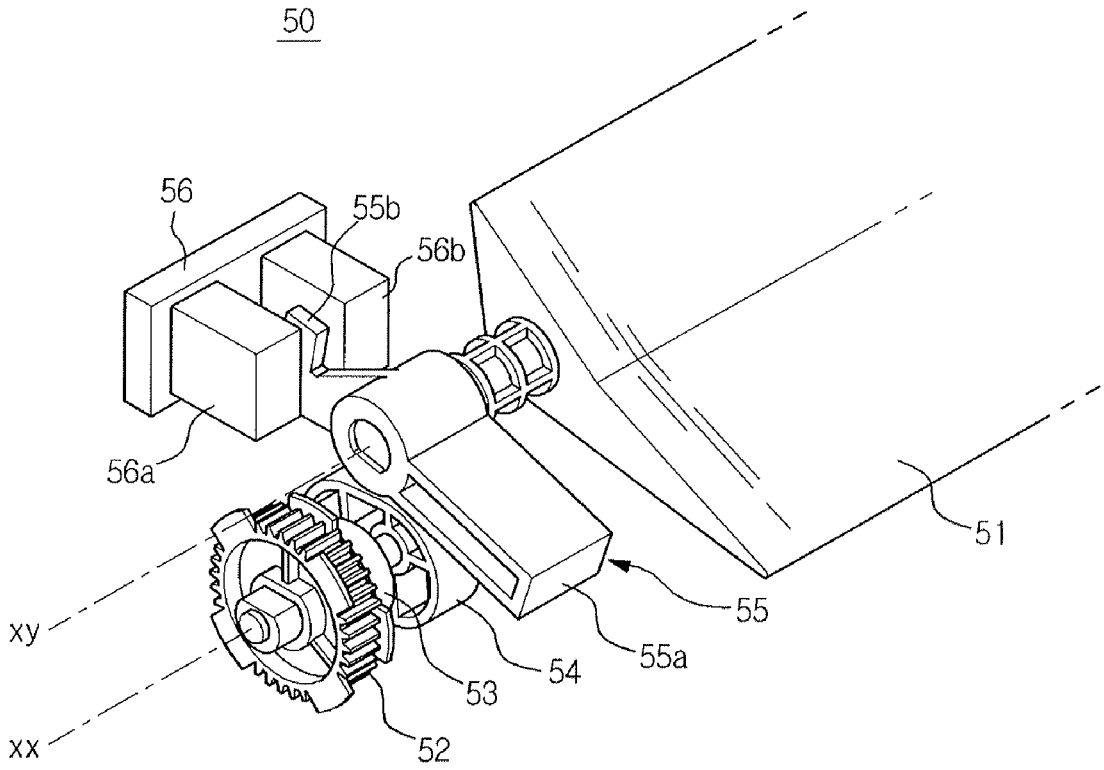
FIG. 4 is a perspective view illustrating a path converting device provided in the print-medium post-treatment apparatus according to an exemplary embodiment of the present general inventive concept.

The path converting device 50, as illustrated in FIG. 4, may include a converting guide 51, a converting pulley 52, a converting cam 54, a one-way clutch 53, and a converting lever 55. The converting guide 51 may be rotatably installed at the junction of the first delivery path 16 and the second delivery path 17 and may guide the print media P to any one of the first delivery path 16 and the second delivery path 17 via rotation thereof. The converting pulley 52 may be rotated upon receiving rotational force via the delivery belt 37. The converting cam 54 may have a cam surface provided at an outer circumference thereof and may have a gradually changed radius. The one-way clutch 53 may be interposed between the converting pulley 52 and the converting cam 54 and may serve to selectively transmit rotational force to the converting cam 54 according to a rotating direction of the converting pulley 52. The converting lever 55 may be fixed to the converting guide 51 and may be supported on the cam surface of the converting cam 54. The converting lever 55 may rotate forward or in reverse according to a rotating angle of the converting cam 54, allowing the converting guide 51 to be rotated forward or in reverse within a predetermined angular range.

The converting lever 55 and converting guide 51 may rotate about an axis XY illustrated in FIG. 4. The converting pulley 52, one-way clutch 53, and converting cam 54 may rotate about an axis XX also illustrated in FIG. 4.

Accordingly, the converting cam 54 may be rotated upon receiving rotational force selectively transmitted via the one-way clutch 53 according to a rotating direction of the delivery motor 31. In the present exemplary embodiment of the present general inventive concept, the one-way clutch 53 does not transmit rotational force to the converting cam 54 when the converting pulley 52 is rotated in a first direction, but may transmit rotational force to the converting cam 54 when the converting pulley 52 is rotated in a second direction.

When the delivery motor 31 is rotated in a first direction, one of the delivery rollers 32 and 33 may move the print media P along any one of the first delivery path 16 and the second delivery path 17. On the other hand, when the delivery motor 31 is rotated in a second direction opposite to the first direction, the delivery rollers 32 and 33 may move the print media P in the reverse direction of the first delivery path 16 and the second delivery path 17, causing no print media P to be transmitted to the print-medium post-treatment apparatus 100. In conclusion, although the print media P may be delivered along one of the first delivery path 16 and the second delivery path 17 when the delivery motor 31 is rotated in the first direction, when the delivery motor 31 is rotated in the second direction, the converting cam 54 may be rotated to allow the converting guide 51 to be rotated forward or in reverse according to a rotating angle of the converting cam 54. In this case, the converting guide 51 may be rotated by an angle sufficient to guide the print media P to a selected one of the first delivery path 16 and the second delivery path 17.

In addition, the path converting device 50 may include a sensor 56 to confirm a position of the converting guide 51. In the present exemplary embodiment of the present general inventive concept, the sensor 56 may function to sense a position of the converting lever 55 installed to the converting guide 51, thereby confirming the position of the converting guide 51. For this, the converting lever 55 may consist of a lever part 55*a*, which is supported on the cam surface to allow the converting lever 55 to be rotated in linkage with the converting cam 54, and a sensing part 55*b* to be sensed by the sensor 56. The sensor 56 may include a photo sensor consisting of a light emitting part 56*a* and a light receiving part 56*b*, so that the sensing part 55*b* may pass between the light emitting part 56*a* and the light receiving part 56*b* according to rotation of the converting guide 51.

As described above, assuming that the path converting device 50 is operated upon receiving force from the delivery device 30, namely, assuming that the converting guide 51 is operated upon receiving force from the delivery motor 31, a configuration corresponding to a drive device to drive the path converting device 50 may be omitted and therefore, the print-medium post-treatment apparatus 100 may achieve a reduction in size.

Hereinafter, operation of the print-medium post-treatment apparatus 100 having the above described configuration will be described in detail with reference to the accompanying drawings.

Figure 5:
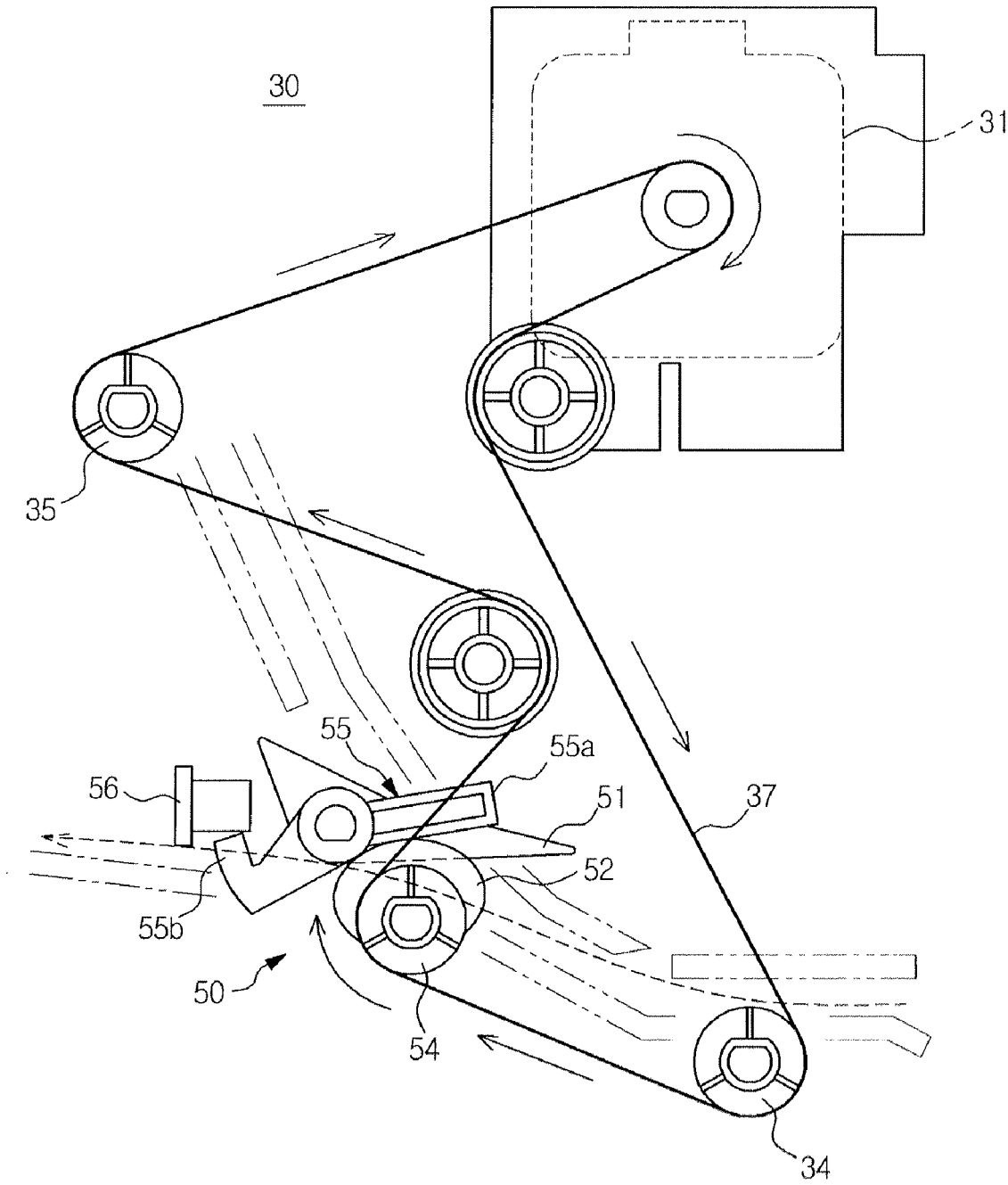
FIG. 5 is a schematic view illustrating operation of the delivery device provided in the print-medium post-treatment apparatus according to an exemplary embodiment of the present general inventive concept.

First, it may be confirmed whether the converting guide 51 is at a desired position or not by confirming whether or not the sensing part 55*b* of the converting lever 55 is present between the light emitting part 56*a* and the light receiving part 56*b* of the sensor 56. If it is sensed that the converting guide 51 is not at the desired position, the delivery motor 31, as illustrated in FIG. 5, may rotate in the second direction to generate rotational force. The converting pulley 52 may rotate in the second direction upon receiving the rotational force via the delivery belt 37.

In this case, since the one-way clutch 53 may transmit the rotational force to the converting cam 54 when the converting pulley 52 is rotated in the second direction, the converting cam 54 may rotate upon receiving the rotational force from the converting pulley 52. With rotation of the converting cam 54, the converting lever 55 supported on the cam surface may rotate in linkage with the converting cam 54.

If the sensor 56 senses that the converting guide 51 is rotated to the desired position via rotation of the converting lever 55, the delivery motor 31, as illustrated in FIG. 3, may rotate in the first direction to generate rotational force. The rotational force generated by the delivery motor 31 may be transmitted to the delivery rollers 32 and 33 via the delivery belt 37 and the delivery pulleys 34 and 35. The delivery rollers 32 and 33 may rotate in the first direction, allowing the print media P to move along the first delivery path 16 or the second delivery path 17.

In this case, although the rotational force is transmitted even to the converting pulley 52 via the delivery belt 37 to cause the converting pulley 52 to be rotated in the first direction, the rotational force may not be transmitted to the converting cam 54 because the one-way clutch 53 provided between the converting pulley 52 and the converting cam 54 transmits rotational force to the converting cam 54 only when the converting pulley 52 is rotated in the second direction opposite to the first direction. Thus, when the delivery motor 31 is rotated in the first direction, no rotational force may be transmitted to the converting cam 54, causing no rotation of the converting cam 54.

Although the converting guide 51 of the exemplary embodiment of the present general inventive concept is installed at the junction of the first delivery path 16 and the second delivery path 17 to guide the print media P, the converting guide is not limited the present exemplary embodiment, and may be arranged at one of junctions of different delivery paths, such as a junction of the main delivery path 18 and the bookbinding delivery path 19, to guide the print media P.

Further, although the converting guide 51 of the present exemplary embodiment of the present general inventive concept is rotated upon receiving force from the converting cam 54 via the converting lever 55, this is given only by way of example, and the converting guide 51 may be rotated forward or in reverse upon directly receiving force from the converting cam 54 without a configuration corresponding to the converting lever 55.

Furthermore, although the sensor 56 of the exemplary embodiment of the present general inventive concept senses a position of the converting guide 51 by sensing a position of the converting lever 55, this is given only by way of example and thus, the sensor 56 may directly sense the position of the converting guide 51.

As apparent from the above description, according to the exemplary embodiment of the present general inventive concept, a converting guide provided in a path converting device may be rotated upon receiving rotational force from a delivery motor. This may enable omission of a configuration corresponding to a drive device to drive the converting guide, resulting in a reduction in size of a print-medium post-treatment apparatus.

Although the exemplary embodiment of the present general inventive concept has been illustrated and described, it would be appreciated by those skilled in the art that changes may be made in these exemplary embodiments without departing from the principles and spirit of the general inventive concept, the scope of which is defined in the claims and their equivalents.

What is claimed is:

1. A print-medium post-treatment apparatus comprising:
a body;
a first stack tray and a second stack tray provided at one side of the body;
a first delivery path and a second delivery path to guide a print medium to the first stack tray and the second stack tray;
at least one delivery roller arranged on at least one of the first delivery path and the second delivery path;
a delivery motor to rotate the delivery roller;
a converting guide to guide the print medium to any one of the first delivery path and the second delivery path;
a converting cam having a cam surface provided at an outer circumference thereof and adapted to operate the converting guide; and
a one-way clutch to selectively transmit rotational force of the delivery motor to the converting cam according to a rotating direction of the delivery motor.

2. The apparatus according to claim 1, further comprising:
a delivery pulley connected to the delivery roller via a shaft;
a delivery belt to transmit the rotational force from the delivery motor to the delivery pulley; and
a converting pulley to receive the rotational force via the delivery belt, the one-way clutch being provided between the converting cam and the converting pulley.

3. The apparatus according to claim 1, wherein:
the delivery roller moves the print medium via one of the first delivery path and the second delivery path when the delivery motor is rotated in a first direction; and
the one-way clutch selectively transmits the rotational force of the delivery motor to the converting cam only when the delivery motor is rotated in a second direction opposite to the first direction.

4. The apparatus according to claim 1, further comprising a converting lever installed to the converting guide and supported on the cam surface so as to be rotated forward or reverse according to rotation of the converting cam.

5. The apparatus according to claim 4, further comprising a sensor to sense a position of the converting guide.

6. The apparatus according to claim 5, wherein:
the sensor senses a position of the converting lever to sense the position of the converting guide from the position of the converting lever; and
the converting lever includes a lever part supported on the cam surface and a sensing part to be sensed by the sensor.

7. The apparatus according to claim 6, wherein the sensor includes a light emitting part and a light receiving part, so that the sensing part passes between the light receiving part and the light emitting part.

8. A print-medium post-treatment apparatus comprising:
a body;
a plurality of delivery paths defined in the body to guide a print medium;
a delivery motor to generate rotational force so as to move the print medium along the plurality of delivery paths;
a converting guide arranged at a junction of the plurality of delivery paths to allow the print medium to move along any one of the plurality of delivery paths;
a converting cam to be rotated upon receiving the rotational force from the delivery motor so as to operate the converting guide; and
a one-way clutch to selectively transmit rotational force to the converting cam according to a rotating direction of the delivery motor.

9. The apparatus according to claim 8, further comprising:
at least one delivery roller arranged on the plurality of delivery paths;
a delivery pulley connected to the delivery roller via a shaft;
a delivery belt to transmit the rotational force of the delivery motor to the delivery pulley; and
a converting pulley to receive the rotational force via the delivery belt, the one-way clutch being provided between the converting cam and the converting pulley.

10. The apparatus according to claim 9, wherein:
the delivery roller moves the print medium via one of the plurality of delivery paths when the delivery motor is rotated in a first direction; and
the one-way clutch selectively transmits the rotational force of the delivery motor to the converting cam only when the delivery motor is rotated in a second direction opposite to the first direction.

11. The apparatus according to claim 9, further comprising:
a converting lever installed to the converting guide and supported on the converting cam so as to be rotated forward or in reverse according to rotation of the converting cam; and
a sensor to sense a position of the converting lever.

12. The apparatus according to claim 11, wherein:
the converting lever includes a lever part supported on the converting cam and a sensing part to be sensed by the sensor; and
the sensor includes a light emitting part and a light receiving part, so that the sensing part passes between the light receiving part and the light emitting part according to rotation of the converting lever.

13. A multifunctional device providing finishing options to print media transmitted from an image forming apparatus comprising:
a body;
a plurality of stack trays;
a plurality of delivery paths to guide print media to the plurality of stack trays;
a delivery device comprising at least one delivery belt and a delivery motor to rotate the delivery belt;
a converting guide to rotatably guide the print media to one of the first delivery path and second delivery path;
a converting pulley connected to the delivery belt to provide a rotational force to the converting guide; and a clutch to allow transmission of the rotational force from the converting pulley to the converting guide only when the converting pulley is rotated in a certain direction.

14. The multifunctional device of claim 13, further comprising:

a sensor to confirm a position of the converting guide, such that the rotational direction of the delivery belt is dependent upon the sensed position of the converting guide.

15. The multifunctional device of claim 13, further comprising:

a stapler positioned on at least one delivery path of the plurality of delivery paths to staple the print media moving along the at least one delivery path; and a bookbinding device located below the stapler along a second delivery path to bind print media.

16. The multifunctional device of claim 13, wherein the body comprises a print media receiving side to receive print media from the image forming apparatus and the plurality of stack trays are positioned on a side of the body opposite the print media receiving side.

17. The multifunctional device of claim 13, wherein the converting guide comprises of a wedge-shape to rotate within a predetermined angular range.

* * * * *